US006367429B2

(12) United States Patent
Iwasaki et al.

(10) Patent No.: US 6,367,429 B2
(45) Date of Patent: Apr. 9, 2002

(54) INTERMEDIATE FLUID TYPE VAPORIZER

(75) Inventors: Masahide Iwasaki; Kazuhiko Asada, both of Takasago (JP)

(73) Assignee: Kabushiki Kaisha Kobe Seiko Sho, Hyogo (JP)

( * ) Notice: Subject to any disclaimer, the term of this patent is extended or adjusted under 35 U.S.C. 154(b) by 0 days.

(21) Appl. No.: 09/760,726

(22) Filed: Jan. 17, 2001

(30) Foreign Application Priority Data

Jan. 18, 2000 (JP) ..... 2000-013884

(51) Int. Cl.[7] ..... F07C 9/02
(52) U.S. Cl. ..... 122/31.1; 122/33; 62/50.2
(58) Field of Search ..... 122/31.1, 32, 33; 60/641.1, 641.7, 514; 62/50.2

(56) References Cited

U.S. PATENT DOCUMENTS 2,119,091 A * 5/1938 Atkinson et al. ..... 122/33
2,535,996 A * 12/1950 Worn et al. ..... 122/32
3,986,340 A * 10/1976 Bivins, Jr. ..... 122/33
4,224,802 A * 9/1980 Ooka ..... 62/50.2

* cited by examiner

*Primary Examiner*—Jiping Lu
(74) *Attorney, Agent, or Firm*—Reed Smith LLP

(57) ABSTRACT

An intermediate fluid type vaporizer is provided which employs a heat source fluid capable of providing a relatively large temperature difference utilizable for vaporization, and which can make an overall size of the vaporizer more compact. The intermediate fluid type vaporizer comprises an intermediate fluid evaporator constructed by providing heat source tubes in a shell, which contains an intermediate fluid therein, to evaporate the intermediate fluid of liquid phase with heat exchange between the heat source fluid and the liquid intermediate fluid, and a liquefied gas evaporator constructed by providing heat transfer tubes in the shell to evaporate liquefied gas with heat exchange between the liquefied gas and the evaporated intermediate fluid. The heat source tubes are formed by straight tubes arranged so as to constitute two or more passes.

11 Claims, 5 Drawing Sheets

INTERMEDIATE FLUID TYPE VAPORIZER

BACKGROUND OF THE INVENTION

1. Field of the Invention

The present invention relates to an intermediate fluid type vaporizer for heating and vaporizing a low temperature liquid, such as liquefied natural gas (hereinafter referred to as "LNG"), by using an intermediate fluid such as propane.

2. Description of the Related Art

Hitherto, an intermediate fluid type vaporizer using an intermediate fluid in addition to a heat source fluid is known as means for continuously vaporizing a low temperature liquid, such as LNG, with a compact structure (see, e.g., Japanese Unexamined Patent Application Publication No. 53-5207).

FIG. 6 shows one example of such an intermediate fluid type vaporizer for LNG. This conventional vaporizer comprises an intermediate fluid evaporator E1, an LNG evaporator E2, and a natural gas (hereinafter referred to as "NG") heater E3.

The intermediate fluid evaporator E1 comprises a first shell 101, an outlet chamber 102 formed at one end of the first shell 101, an intermediate chamber 103 formed at the other end of the first shell 101, and a large number of heat source tubes 104 disposed in a lower portion of an inner space of the first shell 101 and extending between both the chambers 102, 103. The first shell 101 contains therein an intermediate fluid (e.g., propane) having a boiling point lower than that of sea water as a heat source fluid. The LNG evaporator E2 comprises an inlet chamber 111 and an outlet chamber 112 divided from each other by a partition wall 110, and a large number of heat transfer tubes 113 for communicating both the chambers 111 and 112 with each other. Each of the heat transfer tubes 113 has a substantially U-shape and projects into an upper portion of the inner space of the first shell 101. The NG heater E3 comprises a second shell 120 provided in continuation with the intermediate chamber 103, an inlet chamber 121, and a large number of heat source tubes 122 extending between both the chambers 103, 121.

A heat source fluid (sea water in the illustrated related art) flows through the inlet chamber 121, the large number of heat source tubes 122, the intermediate chamber 103, the large number of heat source tubes 104, and the outlet chamber 102 successively in the order named. Of this route, the heat source tubes 122 are disposed in the NG heater E3 and the heat source tubes 104 are disposed in the intermediate fluid evaporator E1. The outlet chamber 112 of the LNG evaporator E2 is connected to the second shell 120 side of the NG heater E3 through an NG conduit 123.

In such a vaporizer, sea water as a heat source fluid flows into the outlet chamber 102 after passing through the inlet chamber 121, the heat source tubes 122, the intermediate chamber 103, and the heat source tubes 104. While passing through the heat source tubes 104, the sea water is subjected to heat exchange with the intermediate fluid 105 of liquid phase in the intermediate fluid evaporator E1, thereby evaporating the liquid intermediate fluid 105. On the other hand, LNG to be vaporized is introduced to the heat transfer tubes 113 through the inlet chamber 111. The evaporated intermediate fluid 105 condenses with heat exchange between the LNG in the heat transfer tubes 113 and the intermediate fluid 105 of gaseous phase in the intermediate fluid evaporator E1. By receiving heat generated upon condensation of the gaseous intermediate fluid 105, the LNG evaporates and becomes NG in the heat transfer tubes 113. The produced NG is introduced to the NG heater E3 from the outlet chamber 112 through the NG conduit 123, and is further heated with heat exchange between the NG and the sea water flowing through the heat source tubes 122 in the NG heater E3. Thereafter, the NG is supplied to consumers.

With the intermediate fluid type LNG vaporizer having the above-described construction, LNG can be continuously vaporized through repeated evaporation and condensation of the intermediate fluid 105.

In most of intermediate fluid type vaporizers that have been conventionally used, the heat source fluid is sea water. In some of stations employing intermediate fluid type vaporizers, however, another heat source fluid such as warm water or an aqueous solution of glycol has become used in a place where sea water cannot be used from the standpoint of environmental protection, or in the case where sea water is not used to combine the cold heat recovery system.

In a conventional intermediate fluid type vaporizer using sea water as a heat source, a temperature difference obtainable with sea water as a heat source for vaporization is in the range of 5–7° C. Meanwhile, in an intermediate fluid type vaporizer using another heat source fluid such as warm water or an aqueous solution of glycol instead of sea water, a relatively large temperature difference of about 20° C. can be utilized for vaporization.

In the latter vaporizer, therefore, a flow rate of the heat source can be reduced. However, the heat transfer efficiency is deteriorated because a flow speed of the heat source flowing through the heat source tubes 104 in the intermediate fluid evaporator E1 and the heat source tubes 122 in the NG heater E3 cannot be set to a sufficiently high value. Thus, it has been found that, in order to compensate for such a deterioration of the heat transfer efficiency, the overall size of an intermediate fluid type vaporizer must be enlarged, and the cost of a heat exchanger is increased.

One conceivable method for increasing a flow speed of the heat source in the heat source tubes is to reduce the number of the heat source tubes 104 in the intermediate fluid evaporator E1 and the number of the heat source tubes 122 in the NG heater E3. However, reducing the number of the heat source tubes decreases a heat transfer area and hence gives rise to another necessity of increasing the lengths of the heat source tubes 104 in the intermediate fluid evaporator E1 and the heat source tubes 122 in the NG heater E3. This means that, since the intermediate fluid evaporator E1 and the NG heater E3 are connected to each other in series as shown in FIG. 6, the above method requires a longer installation area in the longitudinal direction, impedes free layout in design due to restrictions imposed on an equipment layout plan at a factory site, and eventually needs a larger land for installation.

SUMMARY OF THE INVENTION

In consideration of the state of the art set forth above, it is an object of the present invention to provide an intermediate fluid type vaporizer which employs a heat source fluid capable of providing a relatively large temperature difference utilizable for vaporization, and which can make an overall size of the vaporizer more compact.

To achieve the above object, an intermediate fluid type vaporizer according to the present invention comprises an intermediate fluid evaporator constructed by providing heat source tubes in a shell, which contains an intermediate fluid therein, to evaporate the intermediate fluid of liquid phase with heat exchange between the heat source fluid and the liquid intermediate fluid, and a liquefied gas evaporator constructed by providing heat transfer tubes in the shell to evaporate liquefied gas with heat exchange between the liquefied gas and the evaporated intermediate fluid. The heat source tubes are formed by a plurality of straight tubes, i.e., straight tubes arranged so as to constitute two or more passes.

With the above features, by employing a heat source fluid that is capable of providing a relatively large temperature difference utilizable for vaporization, the required flow rate of the heat source fluid can be reduced. Also, by arranging the heat source tubes of the intermediate fluid evaporator so as to constitute two or more passes, a flow speed of the heat source fluid in each heat source tube can be increased, whereby the heat transfer efficiency is enhanced and a sufficient heat transfer area can be ensured. Therefore, a more efficient and compact heat exchanger can be realized. Further, since the two or more passes of the heat source tubes are constituted by the combination of straight tubes and a return chamber rather than using U-tubes, tube bundles can be arranged in a smaller area, thus resulting in a smaller diameter of the shell and a more compact structure of the vaporizer.

Preferably, the heat source tubes are formed by bundles of straight tubes arranged between tube plates provided at opposite ends of the shell such that the tube bundles are extended to go and return between the tube plates while constituting an even number of passes not less than two. With this feature, inlet and outlet chambers for the heat source fluid can be arranged at one end of the shell, and a return chamber can be arranged at the other end of the shell. As a result, the inlet and outlet chambers for the heat source fluid can be arranged closer to each other.

Preferably, the intermediate fluid type vaporizer further comprises a gas heater for heating gas discharged from the liquefied gas evaporator with heat exchange effected between the discharged gas and the heat source fluid supplied to the intermediate fluid evaporator. In this case, the gas heater can be installed independently of the intermediate fluid evaporator and the liquefied gas evaporator.

More specifically, by arranging the heat source tubes of the intermediate fluid evaporator so as to constitute two or more passes, the heat source tubes of the intermediate fluid evaporator are no longer necessarily arranged in series with respect to the heat source tubes of the gas heater. For this reason, the gas heater can be installed as a separate unit independent of the intermediate fluid evaporator and the liquefied gas evaporator. Therefore, the diameter and length of a shell of the gas heater can be set as appropriate without undergoing limitations imposed by the diameter and length of the shell that is in common to both the intermediate fluid evaporator and the liquefied gas evaporator. Consequently, equipment layout of the vaporizer can be more freely designed.

The gas heater is preferably mounted on the shell. This arrangement enables an overall installation area of the vaporizer to be cut down.

Thus, since the intermediate fluid type vaporizer of the present invention employs the heat source fluid capable of providing a relatively large temperature difference utilizable for vaporization and is constructed with a more efficient and compact structure, it can be suitably used for efficiently vaporizing liquefied natural gas into natural gas and supplying the natural gas to consumers.

DESCRIPTION OF THE PREFERRED EMBODIMENTS

Figure 1:
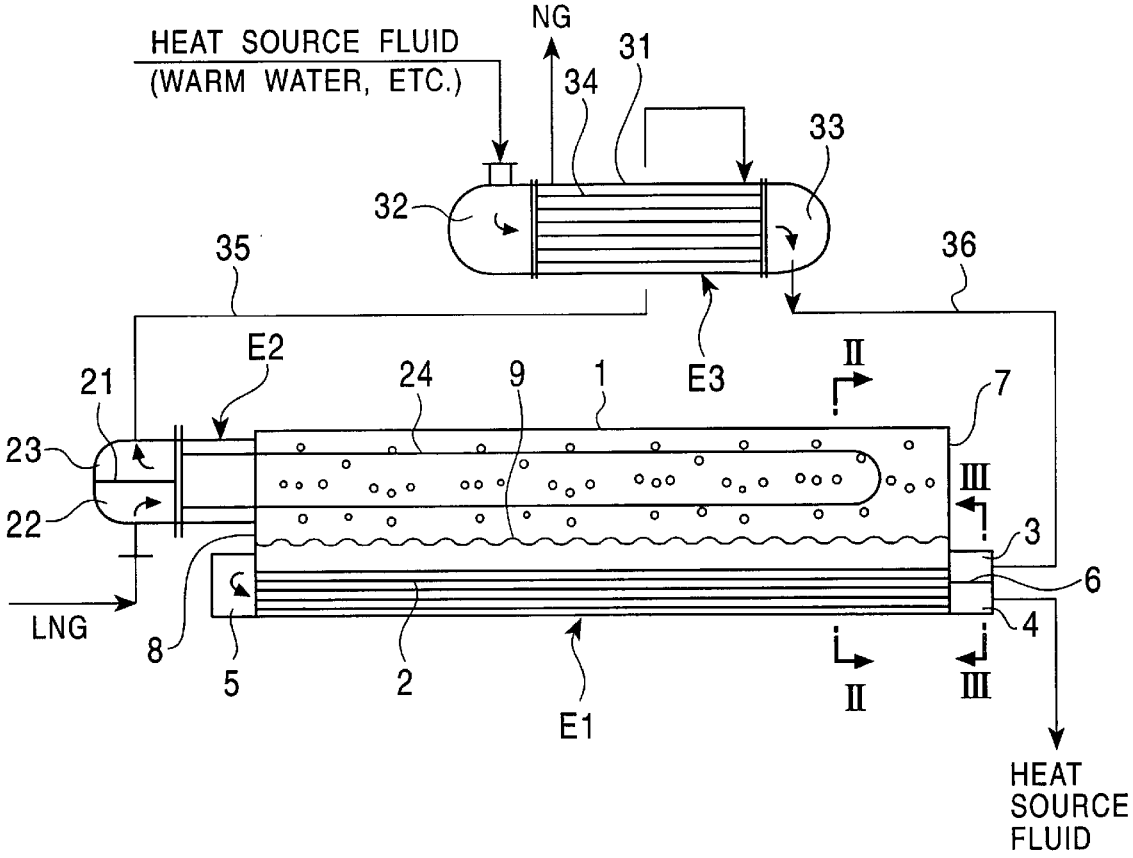
FIG. 1 is a front sectional view of principal part of an intermediate fluid type vaporizer according to one embodiment of the present invention.
Figure 2:
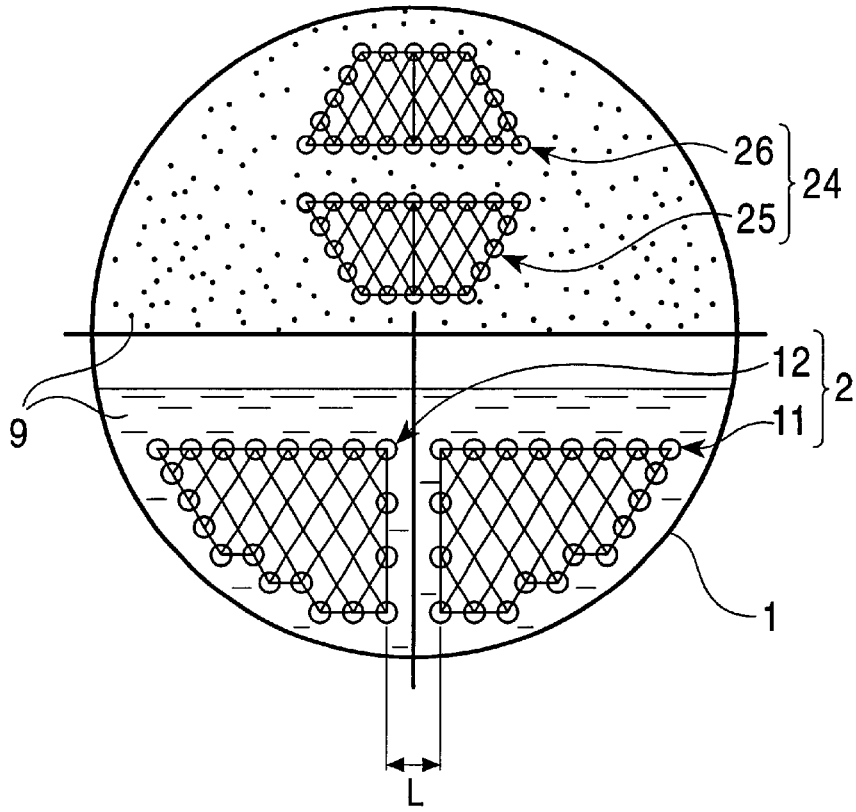
FIG. 2 is a sectional view taken along line II—II in FIG. 1.
Figure 3:
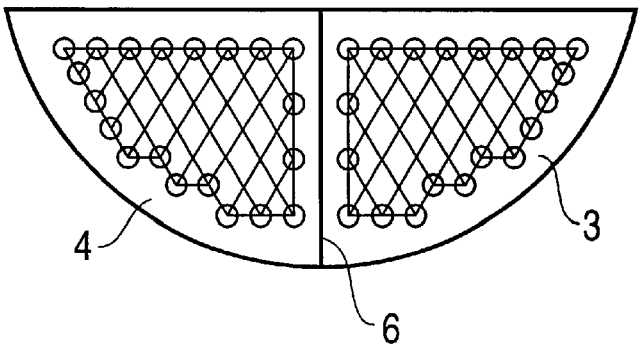
FIG. 3 is a sectional view taken along line III—III in FIG. 1.

An intermediate fluid type vaporizer according to one embodiment of the present invention will be described below with reference to the drawings. FIG. 1 is a front sectional view of principal part of the intermediate fluid type vaporizer according to one embodiment of the present invention, FIG. 2 is a sectional view taken along line II—II in FIG. 1, and FIG. 3 is a sectional view taken along line III—III in FIG. 1.

The intermediate fluid type vaporizer shown in FIG. 1 is suitable for vaporizing LNG by using a heat source fluid, such as warm water or an aqueous solution of glycol, which can provide a relatively large temperature difference utilizable for vaporization of the LNG. The vaporizer comprises an intermediate fluid evaporator E1, an LNG evaporator E2, and an NG heater E3.

The intermediate fluid evaporator E1 comprises a shell 1, a large number of 2-pass heat source tubes 2 provided in a lower portion of an inner space of the shell 1, a heat source inlet chamber 3 and a heat source outlet chamber 4 both provided at one end of the shell 1, and a return chamber 5 provided at the other end of the shell 1.

Each of the heat source tubes 2 has opposite ends fixed to and penetrating through tube plates 7, 8 at both the ends of the shell 1, respectively, and it is in the form of a straight tube. As more clearly shown in FIG. 2, the heat source tubes 2 are made up of a first tube bundle 11 forming a first pass and a second tube bundle 12 forming a second pass. The heat source fluid flows through the first tube bundle 11 from the heat source inlet chamber 3 to the return chamber 5, and the heat source fluid flows through the second tube bundle 12 from the return chamber 5 to the heat source outlet chamber 4. Since the heat source tubes 2 are each in the form of a straight tube, a spacing L between the first tube bundle 11 and the second tube bundle 12 can be minimized so that the diameter of the shell 1 is reduced. If U-tubes are used as the heat source tubes 2, the spacing L would be increased and so would be the diameter of the shell 1 because of a necessary minimum bending radius of the U-tubes. An intermediate fluid 9 is contained in the shell 1, and the heat source tubes 2 are situated in the intermediate fluid 9 of liquid phase. As more clearly shown in FIG. 3, the heat source inlet chamber 3 and the heat source outlet chamber 4 are divided from each other by a partition wall 6.

By so arranging the heat source tube bundle on the inlet side and the heat source tube bundle on the outlet side to separate from each other horizontally, a convection within the shell can be accelerated due to a temperature difference between the heat source tube bundles on both the inlet and outlet sides. The accelerated convection causes vapor of the intermediate fluid to uniformly spread over the entire inner space of the shell, and hence enables heat exchange to be efficiently performed at heat transfer tubes.

The LNG evaporator E2 comprises the same shell 1 as constituting the intermediate fluid evaporator E1, an inlet chamber 22 and an outlet chamber 23 divided from each other by a partition wall 21, and a large number of heat transfer tubes 24 for communicating both the chambers 22, 23 with each other. As more clearly shown in FIG. 2, the heat transfer tubes 24 have a substantially U-form constituted by a lower pass 25 and an upper pass 26, and are horizontally projected into an upper portion of the inner space of the shell 1. The heat transfer tubes 24 are situated in the intermediate fluid 9 of gaseous phase.

Thus, the intermediate fluid type vaporizer has such a structure that the shell 1 of the intermediate fluid evaporator E1 includes therein both the heat source tubes 2 for evaporating the intermediate fluid 9 of liquid phase with heat exchange between the heat source fluid and the liquid intermediate fluid 9, and the heat transfer tubes 24 of the LNG evaporator E2 for evaporating the LNG with heat exchange between the LNG and the intermediate fluid 9 of gaseous phase.

The NG heater E3 is provided separately from the intermediate fluid evaporator E1 and the LNG evaporator E2, and it comprises a shell 31, an inlet chamber 32, an outlet chamber 33, and a large number of heat source tubes 34 for connecting both the chambers 32, 33 to each other. The NG outgoing from the outlet chamber 23 of the LNG evaporator E2 is introduced to the shell 31 of the NG heater E3 through a conduit 35. The heat source fluid outgoing from the outlet chamber 23 of the NG heater E3 is introduced to the heat source inlet chamber 3 of the intermediate fluid evaporator E1. The NG heater E3 serves to heat the NG with heat exchange between the NG and the heat source fluid.

A method of vaporizing the LNG by using the above-described intermediate fluid type vaporizer will now be described with reference to FIG. 1. A heat source fluid, such as warm water or an aqueous solution of glycol, flows into the heat source outlet chamber 4 after passing through the NG heater E3, the heat source inlet chamber 3 of the intermediate fluid evaporator E1, the heat source tubes 2 of the first tube bundle 11 (see FIG. 2), the return chamber 5, and the heat source tubes 2 of the second tube bundle 12 (see FIG. 2). While passing through the heat source tubes 2, the heat source fluid is subjected to heat exchange with the intermediate fluid 9 of liquid phase in the intermediate fluid evaporator E1, thereby evaporating the liquid intermediate fluid 9. On the other hand, LNG to be vaporized is introduced to the heat transfer tubes 24 through the inlet chamber 22. The evaporated intermediate fluid 9 condenses with heat exchange between the LNG in the heat transfer tubes 24 and the intermediate fluid 9 of gaseous phase in the intermediate fluid evaporator E1. By receiving heat generated upon condensation of the gaseous intermediate fluid 9, the LNG evaporates and becomes NG in the heat transfer tubes 24. The produced NG is introduced to the shell 31 of the NG heater E3 from the outlet chamber 21 through the conduit 35, and is further heated with heat exchange between the NG and the heat source fluid flowing through the heat source tubes 34 in the NG heater E3. Thereafter, the NG is supplied to consumers.

In the intermediate fluid type vaporizer of this embodiment, since warm water, an aqueous solution of glycol or the like is employed as the heat source fluid, a relatively large temperature difference can be utilized for vaporization, whereby the required flow rate of the heat source fluid can be reduced and more compact design of the vaporization equipment can be realized. Also, the heat source tubes 2 of the intermediate fluid evaporator E1 are arranged so as to constitute two passes, and the number of the heat source tubes 2 for each pass is reduced. In spite of the reduced flow rate of the heat source fluid, therefore, a flow speed of the heat source fluid in the heat source tubes 2 can be maintained at an appropriate level, and the vaporizer can be designed with high efficiency while maintaining a high film heat transfer coefficient. Further, since the heat source tubes 2 are arranged so as to constitute two passes, a sufficient heat transfer area can be ensured, and hence an axial length of the vaporizer can be reduced. Moreover, since the two passes of the heat source tubes 2 are constituted by the combination of straight tubes and a return chamber rather than using U-tubes, the two tube bundles 11, 12 can be arranged closer to each other in a more compact structure, and the diameter of the shell 1 can be reduced. As a result of the combined effect of those features, it is possible to realize more compact design and a cost reduction of the vaporizer comprising the intermediate fluid evaporator E1 and the LNG evaporator E2 which are constructed as an integral unit.

Also, since the shell 1 being in common to both the intermediate fluid evaporator E1 and the LNG evaporator E2 has a reduced diameter, the volume of the shell 1 can be reduced, and the amount of the intermediate fluid to be maintained in the shell can also be reduced. Therefore, the isolation distance required for safety in accordance with the applicable regulations can be set to a smaller value.

Furthermore, since the heat source tubes 2 of the intermediate fluid evaporator E1 are constituted by the combination of straight tubes and a return chamber, it is possible to more easily carry out inspection and maintenance of the heat source tubes 2, which require the chambers 3, 4 and 5 at the opposite ends of the shell 1 to be removed when the inspection and maintenance are carried out. Should the heat source tubes are damaged, they can be replaced by new ones.

Figure 4:
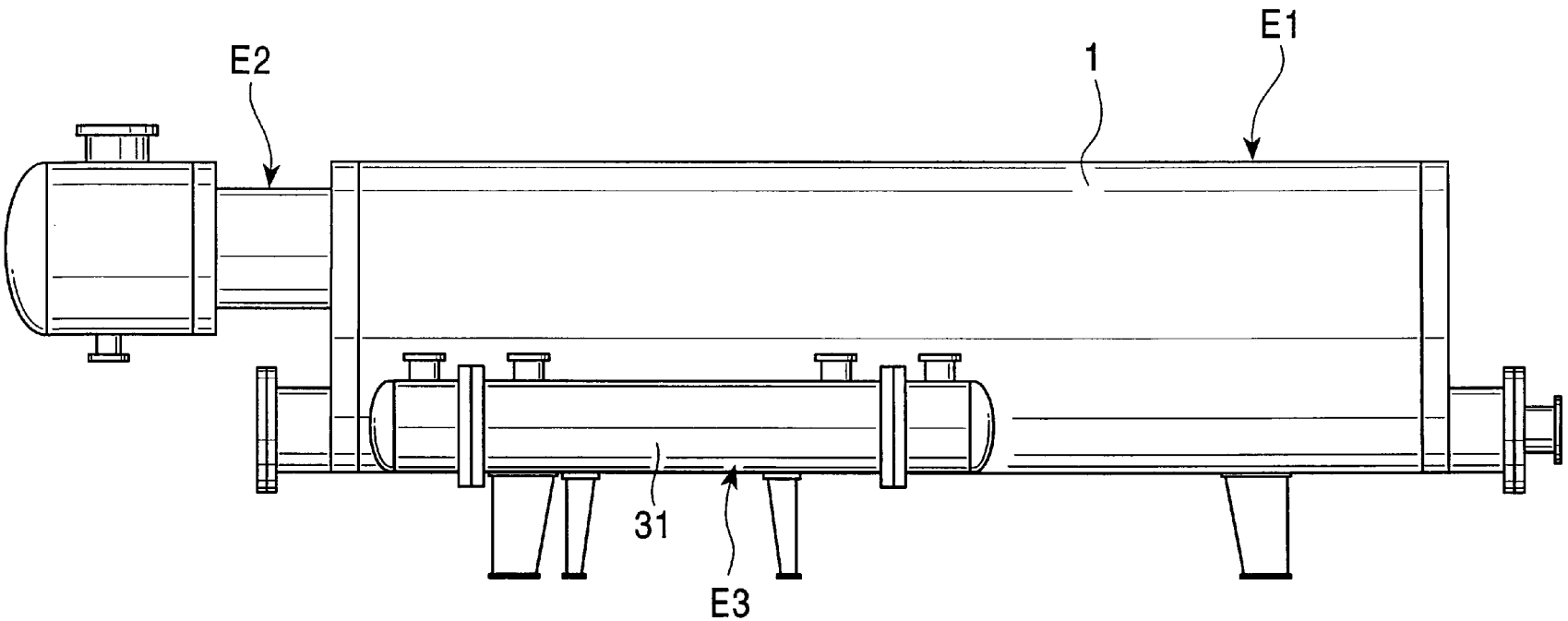
FIG. 4 is a front view showing one example of equipment layout of the intermediate fluid type vaporizer according to the present invention.
Figure 5:
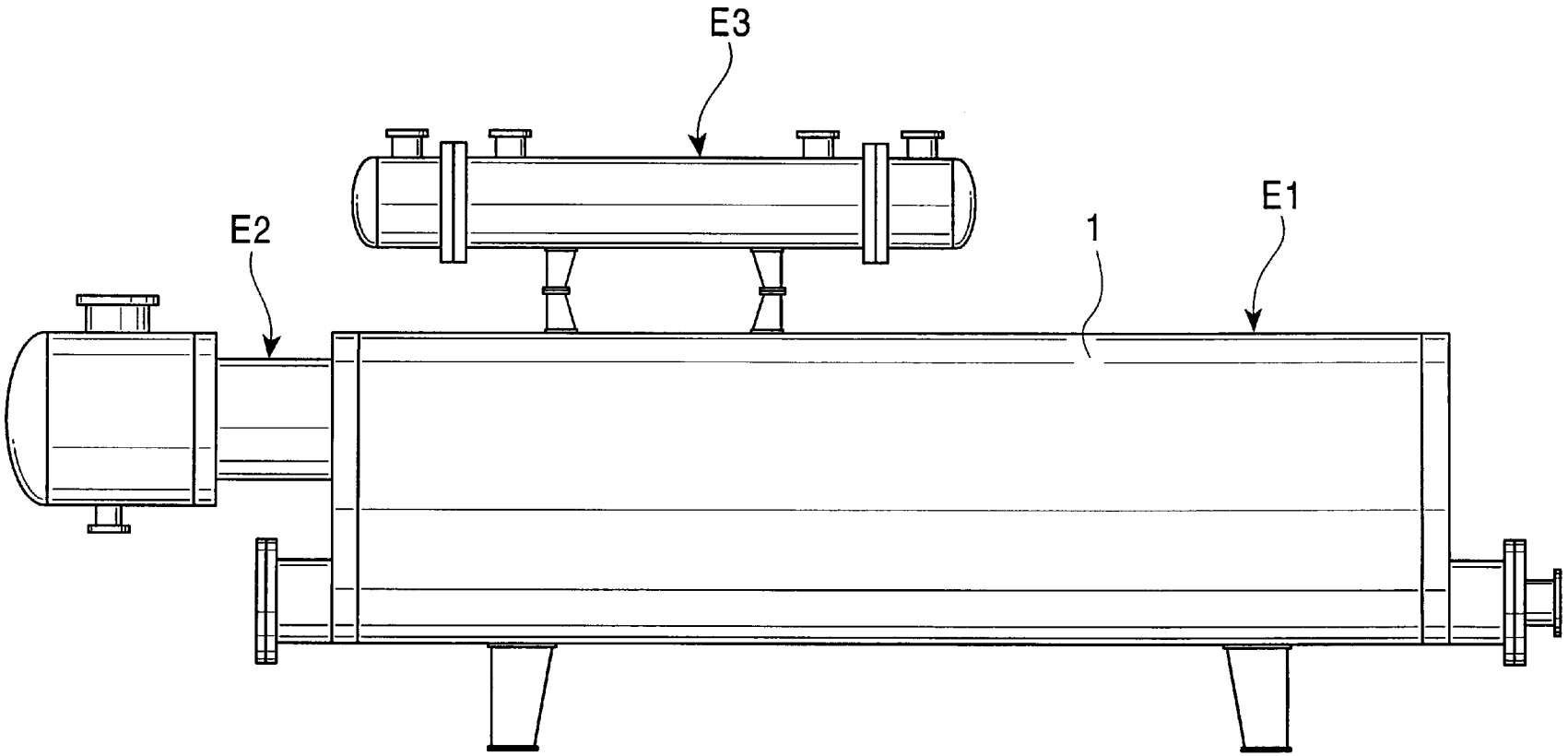
FIG. 5 is a front view showing another example of equipment layout of the intermediate fluid type vaporizer according to the present invention.
Figure 6:
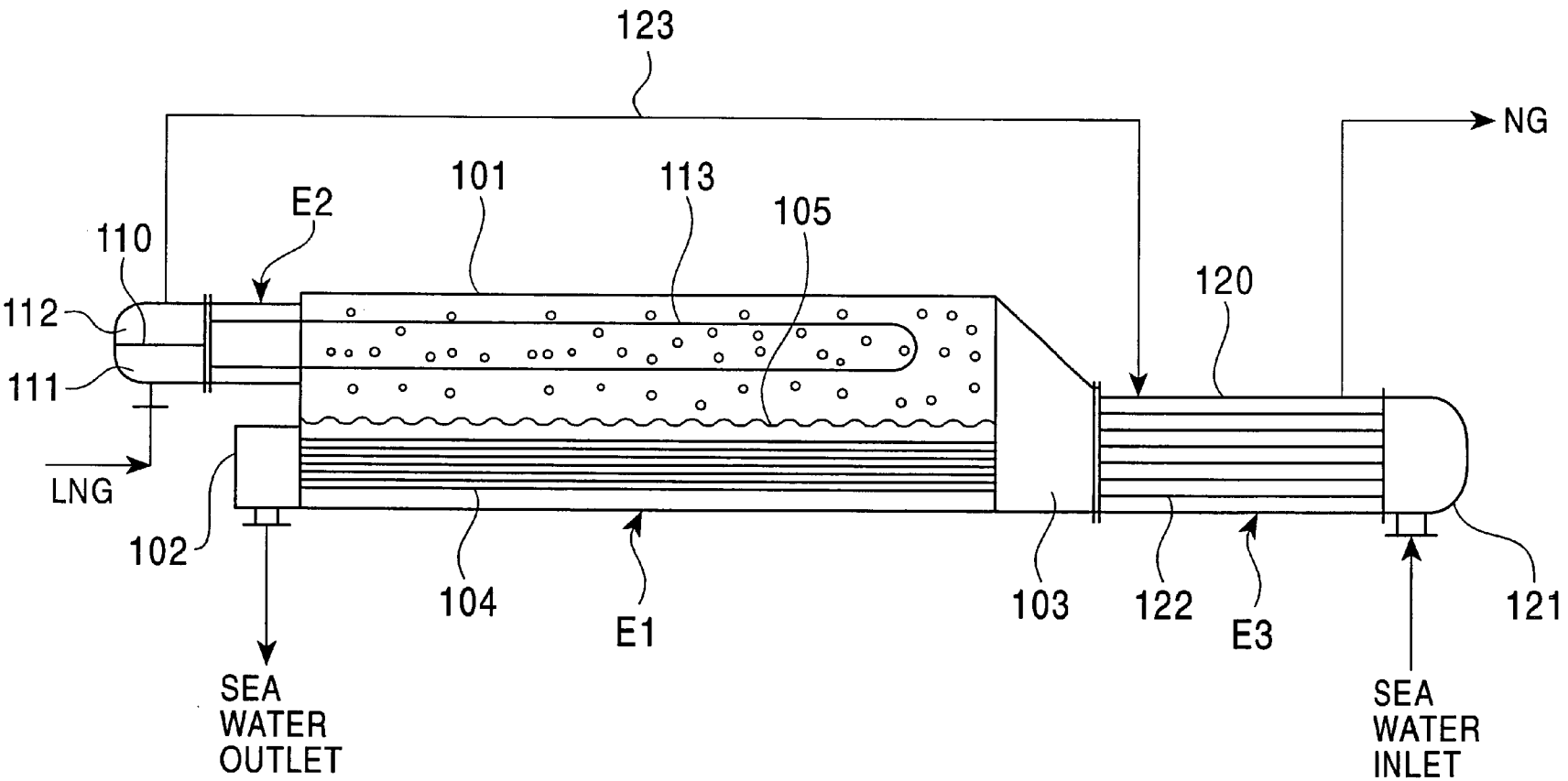
FIG. 6 RELATED ART
FIG. 6 is a front sectional view of principal part of a conventional intermediate fluid type vaporizer.

Moreover, since the NG heater E3 is constituted as an independent heat exchanger separate from the intermediate fluid evaporator E1 and the LNG evaporator E2, the NG heater E3 can be freely designed from the viewpoint of chemical engineering without being affected by the size of the shell 1 unlike the case where the shell 1 is used in common to both the intermediate fluid evaporator E1 and the NG heater E3, whereby the NG heater E3 can be constructed in more compact size. In addition, a more free arrangement and combination of the NG heater E3 can be realized relative to the intermediate fluid evaporator E1 and the LNG evaporator E2. For example, as shown in FIG. 4, the shell 1 of the intermediate fluid evaporator E1 and the shell 31 of the NG heater E3 may be arranged in parallel. Alternatively, as shown in FIG. 5, the shell 31 of the NG heater E3 may be mounted on the shell 1 of the intermediate fluid evaporator E1. This vertical mounting of the shells can reduce an overall installation area of the vaporizer.

Note that the present invention is not limited to the illustrated embodiment, but may be implemented, by way of example, as follows.

(1) The intermediate fluid type vaporizer may comprise only the intermediate fluid evaporator E1 and the LNG evaporator E2. If the temperature of the NG vaporized by the LNG evaporator E2 is not lower than 0° C., the vaporized NG can be directly supplied to consumers without being heated by the NG heater E3.

(2) The heat source tubes 2 of the intermediate fluid evaporator E1 can be constructed so as to provide three, four or more passes. In these cases, a partition wall is provided between adjacent chambers at the opposite ends of the shell 1 for appropriate separation. Employing an even number of passes, such as four or six passes, is more advantageous from the standpoint of piping design because outlets and inlets of the heat source tubes 2 can be arranged at one end of the shell 1.

(3) The heat source fluid used in the present invention is not limited to warm water or an aqueous solution of glycol, but may be selected from other various heat source fluids.

(4) The intermediate fluid used in the present invention is not limited to propane, but may be selected from other various fluids.

(5) While the above description is made in connection with the case of vaporizing LNG as liquefied gas, a target to be vaporized is not limited to liquefied natural gas. The present invention is also applicable to vaporization of, e.g., liquefied ethylene, $LO_2$ (liquefied oxygen), and $LN_2$ (liquefied nitrogen).

According to the intermediate fluid type vaporizer of the present invention, as described above, heat source tubes of an intermediate fluid evaporator are formed by straight tubes arranged so as to constitute two or more passes. Therefore, when a heat source fluid capable of providing a relatively large temperature difference utilizable for vaporization at a smaller flow rate is used and flows through the heat source tubes, a flow speed of the heat source fluid in each heat source tube can be increased, and a reduction of the boundary-film heat transfer coefficient can be prevented. In addition, a sufficiently large heat transfer area can be ensured between the heat source fluid and each heat source tube, and tube bundles constituted by respective groups of the heat source tubes can be arranged closer to each other. As a result, a more efficient and compact vaporizer can be achieved.

Also, a gas heater is provided independently of both the intermediate fluid evaporator and a liquefied gas evaporator. Therefore, the gas heater can be installed in appropriate layout and can be freely designed from the viewpoint of chemical engineering depending on conditions required in constructing the intermediate fluid type vaporizer, e.g., a restriction in installation area of the vaporizer. Consequently, an installation area of the intermediate fluid type vaporizer can be minimized.

Further, by employing the intermediate fluid type vaporizer of the present invention and using the heat source fluid which can provide a relatively large temperature difference utilizable for vaporization, it is possible to efficiently vaporize liquefied natural gas into natural gas and supply the natural gas to consumers.

What is claimed is:

1. An intermediate fluid type vaporizer comprising:

a shell containing an intermediate fluid therein;

a heat source tube formed by first and second pluralities of straight tubes, which are provided in said shell, and allowing a heat source fluid to flow through said heat source tube for evaporating the intermediate fluid in a liquid phase with heat exchange between the heat source fluid and the liquid intermediate fluid;

a return chamber connecting said first and second pluralities of straight tubes to each other; and a heat transfer tube provided in said shell and allowing liquefied gas to be introduced to and flow through said heat transfer tube for heat exchange between the evaporated intermediate fluid and the liquefied gas, wherein said first plurality of straight tubes is operatively connected to receive the heat source fluid at an inlet side of said shell, said second plurality of straight tubes is operatively connected to output the heat source fluid through an outlet side of said shell, and said first and second pluralities of straight tubes and horizontally spaced from each other so as to generate a temperature differential between the first and second pluralities of straight tubes, whereby convection within said shell is accelerated.

2. An intermediate fluid type vaporizer according to claim 1, wherein said first and second pluralities of straight tubes are formed by an even number of straight tubes.

3. An intermediate fluid type vaporizer according to claim 1, further comprising a gas heater for heating gas discharged from said heat transfer tubes with heat exchange effected between the discharged gas and the heat source fluid before being supplied to said heat source tube.

4. An intermediate fluid type vaporizer according to claim 3, wherein said gas heater is installed independently of said shell.

5. An intermediate fluid type vaporizer according to claim 3, wherein said gas heater is installed on said shell.

6. An intermediate fluid type vaporizer, comprising:

a shell containing an intermediate fluid therein;

first and second heat source tube bundles each formed by a plurality of straight tubes and positioned in said shell, said first heat source tube bundle being operatively connected to receive heat source fluid at an inlet side of said shell and said second heat source tube bundle tube is operatively connected to output the heat source fluid through an outlet side of said shell such that heat source fluid flows through said first and second heat source tube bundles for evaporating the intermediate fluid in a liquid phase with heat exchange between the heat source fluid and the liquid intermediate fluid;

a return chamber connecting said first and second heat source tube bundles to each other;

a heat transfer tube structure provided in said shell operatively connected to have liquefied gas flow therethrough so as to allow heat exchange between evaporated intermediate fluid and the liquefied gas; and means for creating a temperature differential between the first and second heat source tube bundles such that convention within said shell is accelerated, said means including horizontally spacing said first and second pluralities of straight tubes from each other.

7. An intermediate fluid type vaporizer according to claim 6, wherein means for creating the temperature differential includes a partition wall between the first and second heat source tube bundles.

8. An intermediate fluid type vaporizer according to claim 6, wherein said first and second heat source tube bundles are each formed by an even number of straight tubes.

9. An intermediate fluid type vaporizer according to claim 6, further comprising:

a gas heater for heating gas discharge from said heat transfer tube with heat exchange effected between the discharged gas and the heat source fluid supplied to said heat source tube.

10. An intermediate fluid type vaporizer according to claim 9, wherein said gas heater is installed independent of said shell.

11. An intermediate fluid type vaporizer according to claim 9, wherein said gas heater is installed on said shell.

* * * * *